United States Patent [19]

Albers et al.

[11] Patent Number: 4,750,548

[45] Date of Patent: Jun. 14, 1988

[54] DEVICE FOR SEALING RETRACTABLE SOOT-BLOWER LANCES

[75] Inventors: Karl Albers, Anholt; Alfons Temminghoff, Südlohn, both of Fed. Rep. of Germany

[73] Assignee: Bergemann GmbH, Wesel, Fed. Rep. of Germany

[21] Appl. No.: 76,363

[22] Filed: Jul. 22, 1987

[30] Foreign Application Priority Data

Oct. 6, 1986 [DE] Fed. Rep. of Germany ..... 3633980

[51] Int. Cl.[4] ..... F28G 1/00

[52] U.S. Cl. ..... 165/95; 15/377; 122/379; 122/390; 122/392; 277/53; 277/56; 277/DIG. 8

[58] Field of Search ..... 122/379, 381, 382, 390, 122/391, 392; 15/317; 277/53, 55, 56, DIG. 8; 165/95

[56] References Cited

U.S. PATENT DOCUMENTS

| | | | |
|---|---|---|---|
| 2,803,848 | 8/1957 | Demart | 15/317 |
| 4,093,242 | 6/1978 | Terry | 122/392 X |
| 4,302,019 | 11/1981 | Hotger | 277/DIG. 8 |
| 4,452,183 | 6/1984 | Yazidjian | 122/392 |

*Primary Examiner*—Edward G. Favors
*Attorney, Agent, or Firm*—Max Fogiel

[57] ABSTRACT

Device for sealing retractable soot-blower lances at the point of insertion through the wall of a heat exchanger. A labyrinth box consists of lamellas. The lamellas narrowly surround the soot-blower lances and are secured at the outer edge in a wall box. The wall box is tightly sealed to the wall of the heat exchanger and has an air-barrier connection. The object is to allow one wall box to accommodate several soot-blower lances, even when they have different outside diameters. Several soot-blower lances accordingly extend through the wall box and several lamellas radially surround the soot-blower lances alternately either narrowly or loosely.

9 Claims, 1 Drawing Sheet

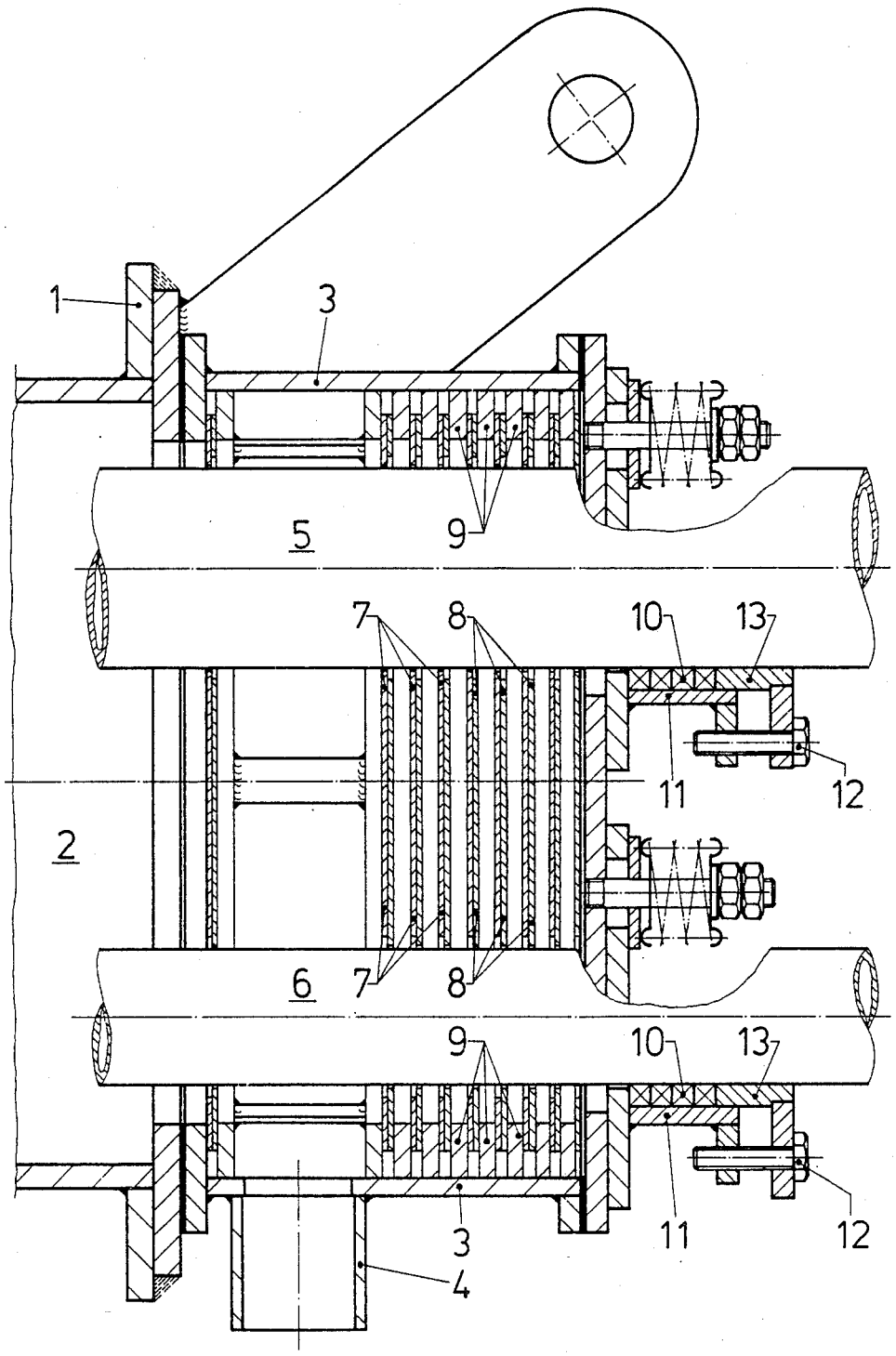
1
3
5
9
7
8
10
13
11
12
2
6
7
8
9
10
13
3
11
12
4

DEVICE FOR SEALING RETRACTABLE SOOT-BLOWER LANCES

BACKGROUND OF THE INVENTION

The invention concerns a device for sealing retractable soot-blower lances.

A separate wall box is provided for each soot-blower lance in this method of sealing in relation to pressure at the flue-gas end. A labyrinth box is usually employed with soot-blower lances of this type, which move axially or helically. A packing box is employed instead of a labyrinth box for soot blowers that only rotate.

SUMMARY OF THE INVENTION

The object of the invention is to improve a sealing device of the aforesaid genus to the extent that one wall box can accommodate several soot-blower lances, even when they have different outside diameters.

This object is attained in accordance with the invention in a device of the aforesaid type by means of the characteristics recited in the body of claim 1. Practical embodiments of the invention are recited in the subsidiary claims.

The lamellas in a sealing device of this type are positioned in such a way as to themselves constitute a labyrinth box while simultaneously providing each soot-blower lance individually with enough free space to move. Soot-blower lances that are subjected to different cleaning agents and have different diameters can accordingly be operated both independently and together.

BRIEF DESCRIPTION OF THE DRAWING

One embodiment of the invention will now be specified with reference to the drawing, which is a longitudinal cross-section through a wall box with a sealing device in accordance with the invention.

DESCRIPTION OF THE PREFERRED EMBODIMENTS

The schematically illustrated wall 1 of a heat exchanger has a port 2 that is sealed off by a wall box 3 secured tight to the wall. Wall box 3 is supplied with a connection 4 that supplies a barrier of air that prevents at least pressurized flue gas from escaping.

Several, two in the illustrated embodiment, soot-blower lances 5 and 6 are positioned in wall box 3 and subjected to either a gaseous cleaning agent like steam or air or to a liquid cleaning agent like water. Soot-blower lances 5 and 6 are inserted into the heat exchanger through port 2 to clean out the pipes of the heat exchanger, executing either an axial and linear or helical motion. Once the blowing process is complete, soot-blower lances 5 and 6 are retracted back into wall box 3. It is also possible for one of the soot-blower lances 5 and 6 to be kept constantly inserted into the heat exchanger and execute a simple rotary motion during the blowing process. The two soot-blower lances 5 and 6, which may have different outside diameters, are preferably supplied with different cleaning agents.

Soot-blower lances 5 and 6 are sealed with a labyrinth box, which consists of several lamellas 7 and 8 secured to the outer edge by means of spacer rings 9. Spacer rings 9 are positioned against the wall of wall box 3. Lamellas 7 and 8 are positioned in directly adjacent pairs. Each lamella 7 or 8 or pair of lamellas accordingly radially surrounds one soot-blower lance 5 or 6 closely and the other soot-blower lance 6 or 5 loosely.

Each soot-blower lance 5 and 6 accordingly has enough room to move freely while being perfectly sealed off by lamellas 7 and 8.

Each soot-blower lance 5 and 6 can also be sealed off where it leaves the rear of wall box 3 by a stuffing box that consists of stuffing 10 in contact with soot-blower lances 5 and 6 and surrounded by a housing 11 and that can be drawn over a collar plate 13 by means of screws 12.

The invention has been described herein with reference to exemplary embodiments. It will be understood, however, that it is receptable of various modifications, which will offer themselves to those skilled in the art and which are intended to be encompassed within the protection sought for the invention as set forth in the appended claims.

We claim:

1. An arrangement for sealing retractable soot-blower lances at a location where said lances are inserted through a wall of a heat exchanger, comprising: a labyrinth box having lamellas surrounding tightly said soot-blower lances with predetermined play; said labyrinth box comprising a wall box sealed tightly to a wall of a heat exchanger, said lamellas having an outer edge secured in said wall box; an air-barrier connection on said wall box; said soot-blower lances extending through said wall box; said lamellas radially surrounding tightly alternate ones of said lances with predetermined play.

2. An arrangement as defined in claim 1, wherein said lamellas surrounding tightly alternate lances are positioned directly adjacent to one another in sections.

3. An arrangement as defined in claim 1, wherein said wall box has a rear side, said lances leaving said rear side of said wall box; and a stuffing box for sealing off said lances where they leave said rear side of said wall box.

4. An arrangement for sealing retractable soot-blower lances at a location where said lances are inserted through a wall of a heat exchanger, comprising: a labyrinth box having lamellas surrounding tightly said soot-blower lances; said labyrinth box comprising a wall box sealed tightly to a wall of a heat exchanger, said lamellas having an outer edge secured in said wall box; an air-barrier connection on said wall box; said soot-blower lances extending through said wall box; said lamellas radially surrounding alternate ones of said lances with a radial gap therebetween to provide play between said lamellas and said alternate ones of said radial gap.

5. An arrangement as defined in claim 4, wherein said wall box has a rear side, said lances leaving said rear side of said wall box; and a stuffing box for sealing off said lances where they leave said rear side of said wall box.

6. An arrangement as defined in claim 4, wherein said lamellas surrounding alternate lances with said radial gap are positioned directly adjacent to one another in sections.

7. An arrangement for sealing retractable soot-blower lances, comprising: a soot blower with a wall, said lances passing through said wall at a location and being sealed at said location where said lances pass through said wall; a wall box arranged at said location and connected tightly to said wall with an air-tight connection; a plurality of soot-blower lances passing through said wall box; labyrinth sealing means with lamellas surrounding said lances with radial play between said lamellas and said lances; said lamellas having an outer rim held in said wall box; said lamellas surrounding alternatingly one lance with less play than another lance.

8. An arrangement as defined in claim 7, wherein said lamellas surrounding tightly alternate lances are positioned directly adjacent to one another in sections.

9. An arrangement as defined in claim 7, wherein said wall box has a rear side, said lances leaving said rear side of said wall box; and a stuffing box for sealing off said lances where they leave said rear side of said wall box.

* * * * *